United States Patent [19]

Carr et al.

[11] 4,045,858

[45] Sept. 6, 1977

[54] CORE TRANSFER PROCESS

[75] Inventors: David M. Carr; Thomas O. Chandler, both of Tuscaloosa, Ala.

[73] Assignee: Monsanto Company, St. Louis, Mo.

[21] Appl. No.: 719,862

[22] Filed: Sept. 1, 1976

Related U.S. Application Data

[63] Continuation of Ser. No. 595,971, July 14, 1975, abandoned.

[51] Int. Cl.[2] ..... D01H 9/00; B23P 19/02

[52] U.S. Cl. ..... 29/427; 29/234; 29/450

[58] Field of Search ..... 8/155; 28/1 R, 21, 72 R, 28/75 WT; 29/234, 427, 450; 57/52; 68/189, 198; 214/1 BS, 8.5 F; 242/1 R, 46.6; 294/86.12, 87 R

[56] References Cited

U.S. PATENT DOCUMENTS

| | | | |
|---|---|---|---|
| 2,298,183 | 10/1942 | Susen | 29/234 X |
| 2,642,655 | 6/1953 | Davis, Jr. et al. | 29/234 |
| 3,315,338 | 4/1967 | Tigges | 29/234 |
| 3,374,959 | 3/1968 | Tigges | 29/234 UX |
| 3,425,110 | 2/1969 | Willis | 28/75 WT |
| 3,477,113 | 11/1969 | Tigges | 29/234 X |
| 3,564,695 | 2/1971 | Willis et al. | 29/234 |
| 3,568,293 | 3/1971 | Young, Jr. | 29/234 |
| 3,681,007 | 8/1972 | Girard | 8/155 |
| 3,710,431 | 1/1973 | Willis et al. | 29/234 X |
| 3,833,974 | 9/1974 | Girard | 28/1 R |
| 3,906,597 | 9/1975 | Dellinger | 28/1 R |
| 3,906,598 | 9/1975 | Hacker | 28/1 R |

*Primary Examiner*—Robert R. Mackey
*Attorney, Agent, or Firm*—Kelly O. Corley

[57] ABSTRACT

A new and useful process of substituting one core for another in a wound package of textile yarn is provided. In preparation for subsequent liquid treatment of yarn wound on a substantially non-perforate rigid cylindrical core by substituting therefor a liquid-permeable longitudinally resilient cylindrical core of about the same or slightly smaller diameter, the package of yarn is first axially compressed. Then, the rigid core is pushed internally from the package while the resilient core substantially at the same time is pulled from a position external of the package to a position internal of the package to replace the rigid core with the resilient core. The application of the axial compression during core transfer prevents or minimizes rumpling of the yarns forming the outer portion of the package. The process is particularly suitable for preparing a package of false twist crimped polyester continuous multi-filament yarn for package dyeing.

4 Claims, 9 Drawing Figures

CORE TRANSFER PROCESS

This is a continuation of application Ser. No. 595,971 filed July 14, 1975, now abandoned.

BACKGROUND OF THE INVENTION

1. Field of the Invention

The present invention relates to a process of substituting in situ one core for another core in a yarn package. More particularly, it relates to a process of substituting for a liquid-impermeable rigid core in a yarn package a liquid-permeable resilient core in preparation for dyeing or otherwise treating the yarn forming the package with a liquid.

2. Prior Art

Today vast quantities of man-made continuous filament yarn are textured by various processes in order to enhance the bulk and stretch characteristics of fabric made therefrom. One such texturing method involves heat setting a false twist imposed on a running threadline. After the false twist crimp is lastingly impressed on the threadline, it is taken up in an orderly manner by being wound on a core. It is commonplace that the core is fabricated from spirally wound paper or paperboard sheets using an adhesive to bond the paper plies. Such a core is rigid and normally imperforate to liquids and must be sufficiently strong to withstand contractive forces developed by the wound yarn. It is often desirable to dye in package form the textured yarn that has been wound on such a core. Package dyeing requires circulating dye liquid evenly through the package from outside to inside of the package or vice-versa. Obviously, an imperforate core does not permit even and thorough penetration of the dye liquid throughout the package as is needed. Hence, the yarn to be dyed must be removed or rewound on a core that permits passage therethrough of a dye liquid. Mere removal of the imperforate core is not satisfactory because the yarn on the inside windings of the package tends to become disarranged and entangled during dyeing. This gives rise to difficulties during subsequent knitting or weaving of the dyed yarn. Rewinding of the yarn from the imperforate core to a dye liquid-perforate core is quite expensive. At the present time it is common practice in the industry to replace the imperforate core with a perforate core without rewinding, thereby permitting free flow of liquid therethrough but at the same time having a core to impart needed stability to the windings during liquid treatment.

In U.S. Pat. No. 3,425,110 core replacement is accomplished by simultaneously inserting a perforate core, such as a foraminous stainless steel dye tube or dye spring, while removing the imperforate core by pushing out the former with the latter. The diameter of the replacement core is usually only very slightly smaller than the diameter of the imperforate core of the yarn package. It has been found that while the windings are rendered stable during liquid treatment and the small difference in diameter permits a correct amount of inward expansion of the package to achieve a desired uniform bulk level throughout the package, the windings become disarranged by the movement of the cores during transfer. In particular, the windings in the vicinity of where the replacement core enters the package and the inner windings are noticeably rumpled.

In U.S. Pat. No. 3,681,007 another core replacement procedure is suggested. A perforate core is placed internally of a rigid imperforate core of which yarn is wound. While the package is under axial compression the imperforate core is removed while at the same time preventing axial movement between the yarn package and the perforate core. To withstand the contraction forces of the yarn, the imperforate core must have a rather thick wall. For example a core with a 4 inch diameter may have a wall thickness of one fourth inch or more. Hence the difference between the outside diameter of the replacement core and the inside diameter of the yarn package is even larger. Unfortunately, such a difference permits the inside windings to expand to the extent that the bulk level of the yarn from inside to outside of the package is not satisfactorily uniform.

Hence there is a need in the art to provide a core transfer process wherein disarrangement of the windings is minimized while at the same time a satisfactorily even bulk level is maintained throughout the package.

SUMMARY OF THE INVENTION

There is provided a new and useful process for replacing a rigid imperforate hollow cylindrical core internally supporting a package of yarn with a liquid permeable hollow cylindrical core of the same or slightly smaller diameter. A foraminous dye tube or dye spring is axially aligned with the imperforate core in close end-to-end relation. The liquid permeable core may be inserted into the imperforate core for a short distance only. For example, the liquid permeable core will be inserted for a distance of no more than about 35 percent of the lengthwise distance of the imperforate core. The package is positioned between a pair of pressure plates or discs. The plates are moved relative to one another to cause the package to be axially compressed by a squeezing action of the plates. A transfer head equipped with expandable rubber rings is inserted axially of the core; at least one rubber ring is positioned within the confines of each of the cores. Thereupon, the rubber rings are expanded to grip both of the cores. The transfer head is withdrawn from the centers of the cores as the package remains relatively stationary to simultaneously pull both cores in tandem along the axis of the yarn package for a predetermined distance during which time the rubber ring gripping the perforate core is decompressed to release the perforate core in a suitably centered position within the package. The transfer head is further withdrawn until the imperforate core is moved away from the package. Later the expanded rubber ring gripping the imperforate core is decompressed to release the imperforate core. The pressure plates are moved apart; and the package of yarn now containing a perforate core is removed for subsequent treatment, such as dyeing.

In a second embodiment of the present process, two transfer heads with expandable rubber rings are used. A first transfer head enters the imperforate core whereas the second transfer head enters the liquid permeable core. The package of yarn is placed under axial compression. The first head whose rubber ring or rings are expanded pulls the imperforate core out and away from the package while the other head whose rubber ring or rings are expanded pushes the liquid permeable core into the package to take the place of the imperforate core. The rubber ring or rings gripping the liquid permeable core are decompressed to release the liquid permeable core in a suitably centered position within the package. Then, the second transfer head is retracted to its original position. The rubber ring or rings of the first transfer head holding the imperforate core are decompressed to release the same. The axial pressure on the package is released; and the package of yarn containing the liquid permeable core is now readied for subsequent treatment, such as dyeing.

DETAILED DESCRIPTION

Figure 1:
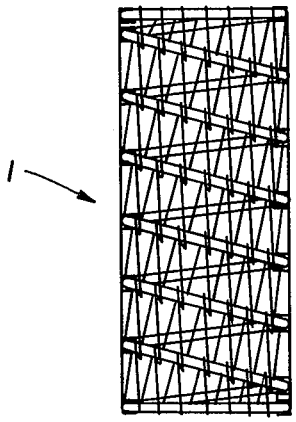
FIG. 1 is a side elevational view of an axially resilient dye spring.

With reference to FIG. 1 numeral 1 generally denotes a dye spring that is conventionally used in the art for effecting package dyeing of yarn wrapped therearound. With such type of core the interpenetration of dye evenly throughout the package is not hindered. As illustrated the spring is axially compressible. The dye spring has an internal coil provided with a sheath formed of a wire which extends in the form of a spiral around adjacent turns of the coil. The compressibility of the spring enables one to dye a greater amount of yarn in a dye vessel of given dimensions. The dye spring is perforate, thus permitting dye liquid to move freely therethrough to impregnate and dye the yarn wrapped therearound. It will of course be recognized that a perforate core having no axial resiliency may be used as well, such as a perforate stainless steel tube commonly used for treating a package of yarn in a yarn package dyeing apparatus.

Figure 2:
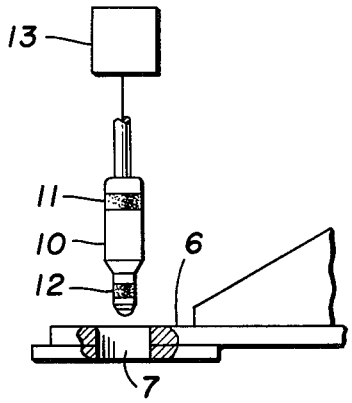
FIG. 2 is a side elevational view partly in cross section of apparatus suitable for use in the core replacement process of the present invention.
Figure 2:
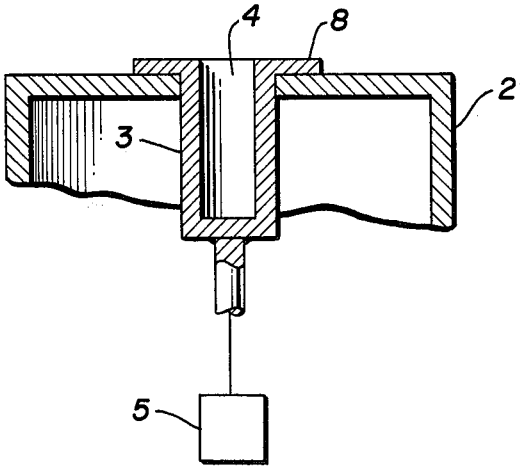

In FIG. 2 there is shown an arrangement of apparatus having cooperatively associated components useful for transferring cores in accordance with the present invention. Framing 2 supports vertically movable chamber 3 which is provided with opening 4 adapted to receive a dye spring. Means 5 is operative to provide vertical reciprocal movement of chamber 3. Specifically, means 5 may be a lift actuated by fluid pressure or the like. Plate 6 fixedly supported by suitable framing is positioned above chamber 3 and is provided with opening 7. Openings 4 and 7 are in vertical alignment and are adapted for free passage therethrough of yarn cores. Flange 8 of chamber 3 is positioned for receiving a package of yarn thereon and is adapted to cooperate with plate 6 for placing such package under axial compression. Positioned above plate 6 in axial alignment with openings 4 and 7 is yarn core transfer head mandrel 10 which is vertically movable. The mandrel has upper expandable ring 11 and lower expandable ring 12. Means 13 is operative to provide vertical reciprocal movement of mandrel 10.

Figure 3:
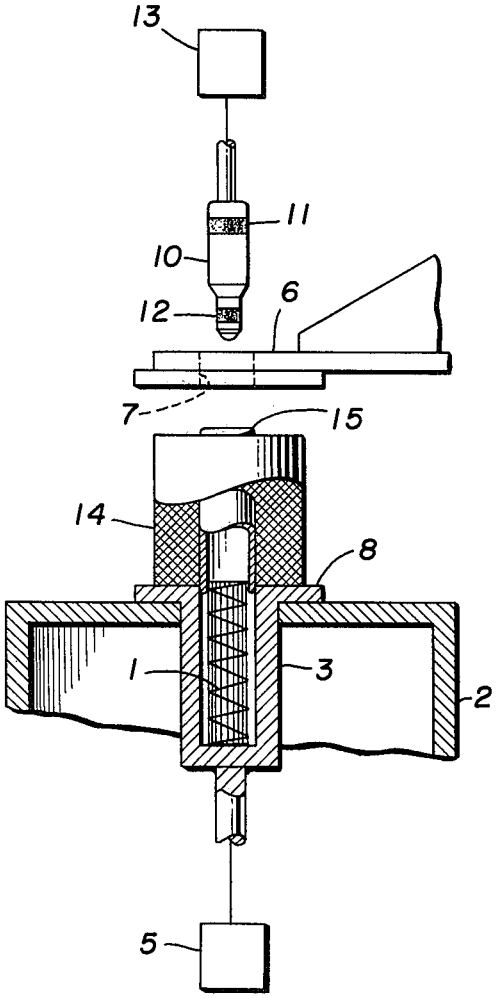
FIG. 3 illustrates the apparatus wherein a solid liquid-impermeable core supporting a package of yarn is in axial alignment with a dye spring.

It will be noted in FIG. 3 spring 1 is positioned internally of chamber 3. Package of yarn 14 having been wound on rigid imperforate core 15 is positioned on flange 8 such that the core is axially aligned with dye spring 1. The outside diameter of spring 1 is very slightly smaller than the inside diameter of core 15. As illustrated the spring extends a short distance inside core 15. It is not necessary that spring 1 extend inside core 15. It maybe desirable that both spring 1 and core 15 have approximately the same outside dimension in which event the ends of the spring and core abut or are in spaced apart relation.

Figure 4:
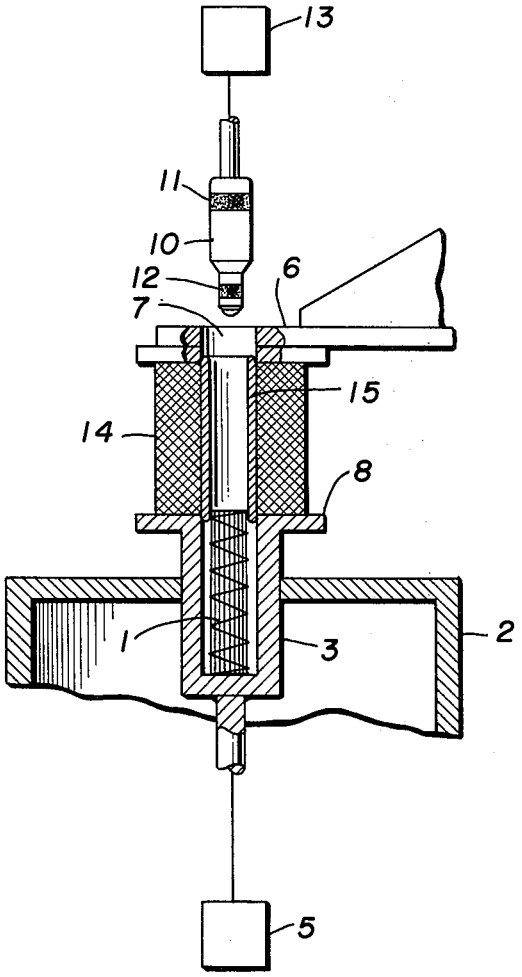
FIG. 4 illustrates the apparatus wherein the package of yarn is compressed by a pair of plates or discs.

In FIG. 4 chamber 3 has been raised to a predetermined position by actuation of means 5. Package of yarn 14 thus is placed under axial compression which tends to stabilize the windings of yarn against disarrangement during core transfer. Mandrel 10 is shown in its elevated position. It may be desirable to first cause means 13 to be actuated to lower mandrel 10 to a position internally of core 15. Positioning the mandrel within core 15 before placing the package of yarn under compression may assist in maintaining proper axial alignment of the core and spring. Alternatively, mandrel 10 may be lowered at the same time that chamber 3 is raised.

Figure 5:
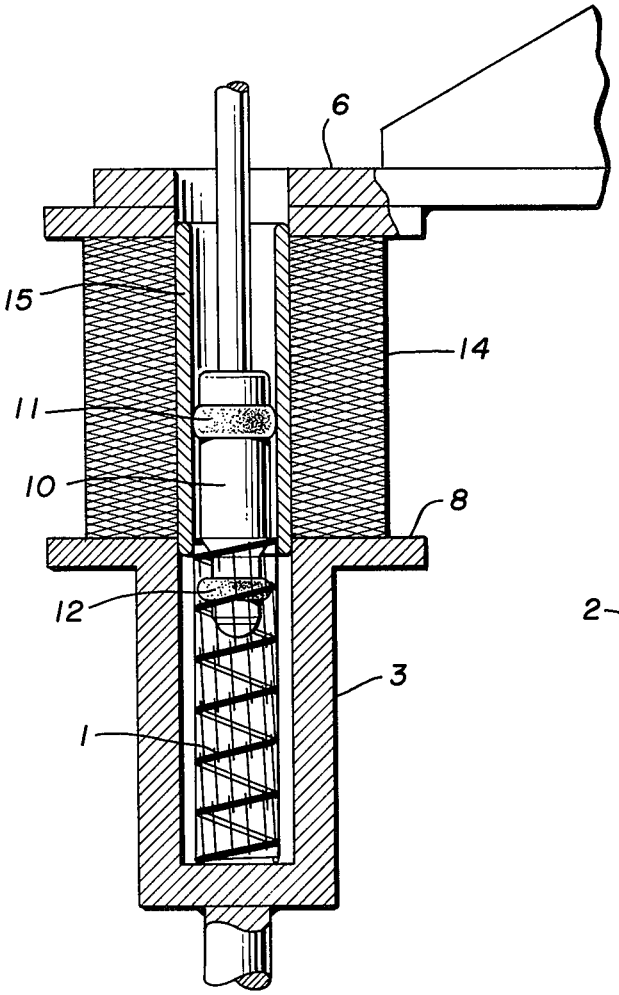
FIG. 5 shows an enlarged view of a transfer head with core gripping means positioned internally of the solid core and dye spring.

In FIG. 5 it is seen that the package of yarn is under axial compression as provided by the relative positioning of place 6 and flange 8. Mandrel 10 is positioned internally of spring 1 and core 15. Rubber rings 11 and 12 are expanded to be in tight gripping relation with respect to core 15 and spring 1.

Figure 6:
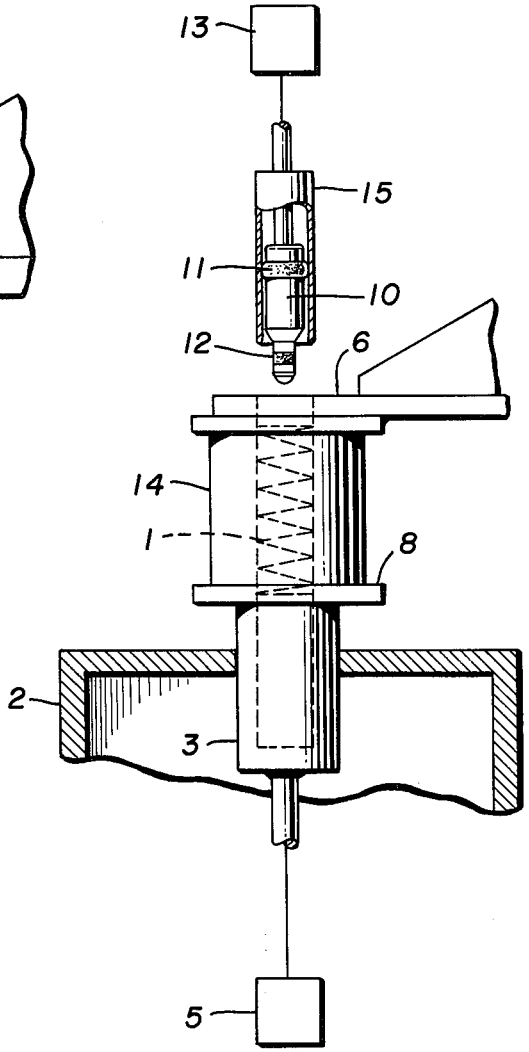
FIG. 6 shows the transfer head removed from the package of yarn and the dye spring suitably positioned internally of the package of yarn.

In the next sequence as can be seen in FIG. 6 mandrel 10 is withdrawn from the package of yarn while the rubber ring 11 is still expanded for gripping core 15. As the mandrel is raised rubber ring 12 is deflated such that its gripping relation with the inside of spring 1 ceases thereby to locate the same properly within the package of yarn. As final steps, rubber ring 11 is deflated and core 15 is removed. Chamber 3 is lowered and the package of yarn now provided with a perforate core is removed from the apparatus for further processing and treating such as in a dye vessel. Thereafter, the entire operation as above described can be repeated.

Figure 7:
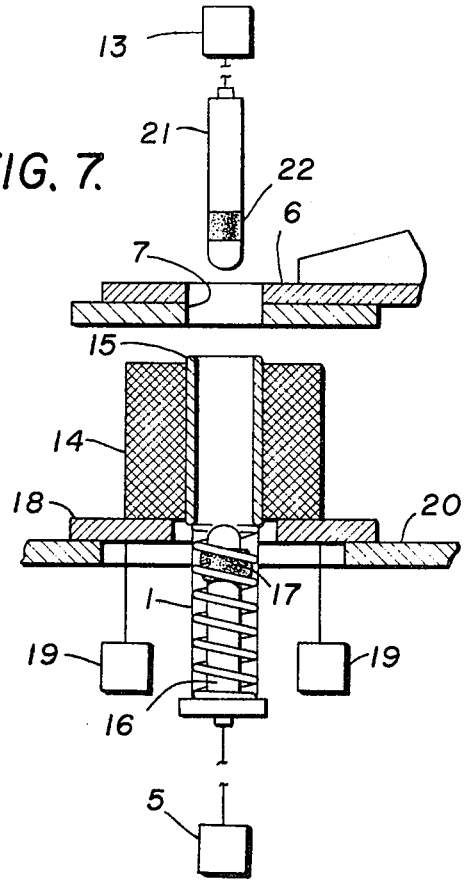
FIGS. 7–9 illustrate a second embodiment of the invention wherein two transfer heads are employed.

In FIG. 7 dye spring 1 has been laced in encircling arrangement with lower transfer head 16 provided with expandable rubber ring 17. Package of yarn 14 wound on rigid core 15 is positioned on lower plate 18 suitably mounted for vertical reciprocal movement provided by means 19. Specifically, means 19 may be a lift actuated by fluid pressure or the like. As shown, the ends of the dye spring and the rigid core abut. Plate 18 rests on stationary table 20. Upper plate 6 fixedly supported by suitable framing is positioned above table 20 and is provided with opening 7. Positioned above plate 6 in axial alignment with core 15 is upper transfer head 21 which is mounted for vertical reciprocation. Transfer head 21 has expandable rubber ring 22. Means 13 is operative to provide predetermined vertical reciprocal movement of transfer head 21. Means 5 is operative to provide predetermined vertical reciprocal movement of transfer head 16.

Figure 8:
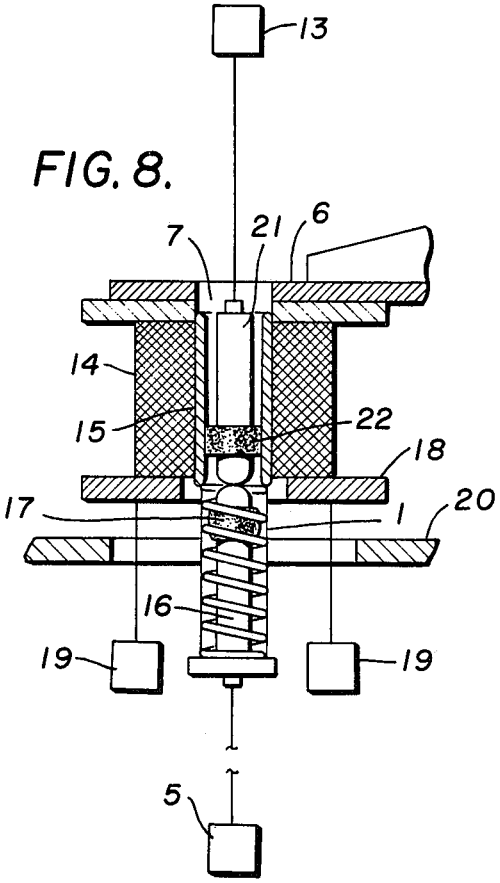

In FIG. 8 transfer head 21 is in a lower position and is inserted within core 15. The expandable rings of transfer heads 16 and 21 have been pressurized and clutch the inside of core 15 and spring 1 in frictional relation. Means 19 has lifted plate 18 to place the package of yarn under suitable axial compression.

Figure 9:
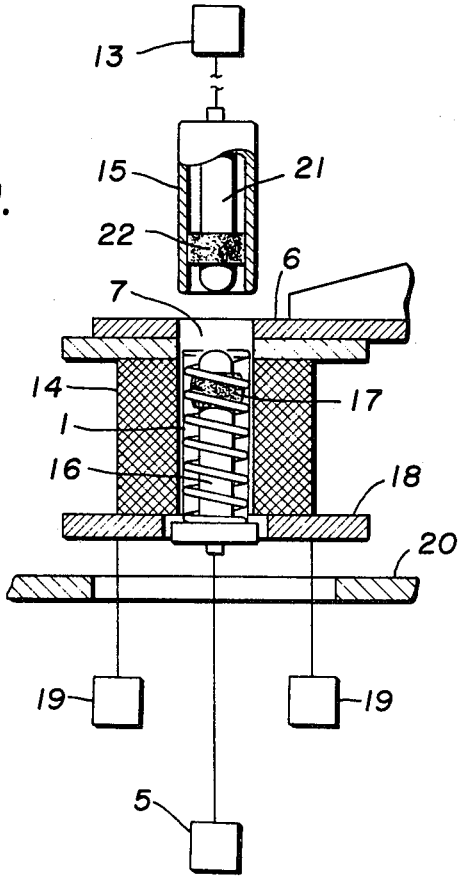

In FIG. 9 transfer head 21 is shown retracted to its original upper position with its rubber ring still expanded and holding core 15. Transfer head 16 is shown in an elevated position so as to center the dye spring suitably with the package of yarn. In the final sequence of the operation of the core transfer device, ring 22 will be deflated and the imperforate core is then removed. Transfer head 16 will be lowered to its original position after deflation of ring 17. Plate 18 will be retracted to its original lower position. Then, the package of yarn is ready to be transferred for subsequent treatment, such as dyeing. It will be obvious that the operation of the apparatus can be partially or fully automated. Hence, such embodiments are considered to be within the scope of the invention.

EXAMPLE

Polyethylene terephthalate continuous filament yarn having a total denier of 150 and being composed of 34 individual filaments was false twist textured by being passed over a heated plate while being false twisted by a rotating pin spindle. The yarn having a false twist crimp impressed on it is collected under a tension of 1.5 grams on a laminated paper tube. The tube had a length of 7.03 inches (17.9 cms.), an outside diameter of 3.42 inches (8.89 cms.) and an inside diameter of 3.26 inches (8.29 cms.). The weight of yarn wound on the tube was 2.8 pounds (1.27 kilogram). The traverse length of the winding was 6.37 inches (16.2 cms.). The ends of the tube projected 0.187 inch (0.47 cm.) from each end of the package. A dye spring as illustrated in FIG. 1 was inserted in chamber 3 of the apparatus. The dye spring had a length of 7.5 inches (19.05 cms.), an outside diameter of 3.10 inches (7.87 cms.) and an inside diameter of 2.65 inches (6.65 cms.). The package was compressed such that the ends of the package were placed under a force of 786 pounds (356 kilograms). A mandrel having a length of 10 inches (25.4 cms.) with an upper portion having an outside diameter of 3.06 inches (7.77 cms.) and a lower portion having an outside diameter of 2.56 inches (6.50 cms.) was inserted in the paper tube and spring. Two rubber rings located on each of the upper and lower portions of the mandrel were inflated and the mandrel withdrawn. The lower rubber ring was deflated as the mandrel was withdrawn to deposit the spring centrally within the package. The package was removed from the machine and dyed in a conventional manner. The package of dyed yarn was inspected. It was observed that the crimp in the yarn had been suitably stabilized and the stabilized crimp was uniform throughout the package. Visual inspection of the package indicated that there was a low incidence of yarn disarrangements occasioned by the transfer of the spring for the core. A measurement was made of the tension of the yarn as it was withdrawn overend of the package. Low variations in tensions encountered as the yarn was completely unwound further indicated that yarn rumpling occasioned by the transfer of the spring for the core was minimal.

We claim:

1. A process for transferring a package of yarn from a hollow core to a dye spring, comprising:

a. in any order:

1. inserting through a first end of said dye spring a reciprocally mounted first transfer head provided with an expandable portion adapted for expansion to grip the remote end of said dye spring,
2. positioning said remote end in axial alignment with said core and in close end-to-end relationship with one end of said core,
3. axially compressing said package, and
4. gripping said core with a second transfer head, followed by b. simultaneously withdrawing said core while inserting said remote end of said dye spring through said package.

2. The process of claim 1 wherein axial compression of the package of yarn is accomplished by pushing the package of yarn in the direction of the location of the second transfer head against a stationary plate member.

3. The process of claim 1 wherein the yarn is false twist textured yarn.

4. The process of claim 1 wherein the yarn is made of polyester polymer.

* * * * *